US007278180B2

(12) United States Patent
Pyeong

(10) Patent No.: US 7,278,180 B2
(45) Date of Patent: Oct. 9, 2007

(54) DEVICE FOR PROTECTING MOTOR IN VACUUM CLEANER

(75) Inventor: Ji Heon Pyeong, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 663 days.

(21) Appl. No.: 10/660,776

(22) Filed: Sep. 12, 2003

(65) Prior Publication Data

US 2004/0049880 A1 Mar. 18, 2004

Related U.S. Application Data

(62) Division of application No. 09/989,460, filed on Nov. 21, 2001, now Pat. No. 6,651,294.

(30) Foreign Application Priority Data

Oct. 15, 2001 (KR) ..... 10-2001-0063270

(51) Int. Cl.
*A47L 9/00* (2006.01)

(52) U.S. Cl. ..... 15/412; 15/347; 15/353; 15/339

(58) Field of Classification Search ..... 15/339, 15/412, 413, 327.7, 353, 347, 421
See application file for complete search history.

(56) References Cited

U.S. PATENT DOCUMENTS 2,439,182 A * 4/1948 Nuffer et al. ..... 15/327.7
3,089,177 A * 5/1963 Andersson-Sason ..... 15/327.1
3,101,889 A * 8/1963 Tatge ..... 15/412
3,170,184 A * 2/1965 Jepson et al. ..... 15/412
3,636,681 A 1/1972 Batson et al. ..... 15/327.2
3,651,536 A 3/1972 Bolzan, Jr. et al. ..... 15/323
3,871,847 A 3/1975 Fish ..... 15/327.6
3,932,911 A 1/1976 Crooks et al. ..... 15/327.6
4,597,131 A 7/1986 Lyman ..... 15/412
4,733,431 A 3/1988 Martin ..... 15/339
5,293,664 A 3/1994 Lim et al. ..... 15/412
5,513,417 A 5/1996 Kim et al. ..... 15/412
5,701,631 A * 12/1997 Lindquist ..... 15/413

(Continued)

FOREIGN PATENT DOCUMENTS

EP 0344136 11/1989

(Continued)

*Primary Examiner*—Theresa T. Snider
(74) *Attorney, Agent, or Firm*—Ked & Associates, LLP

(57) ABSTRACT

A device for protecting a motor in a vacuum cleaner is provided. The device includes a lower casing for forming a lower portion of a main body of the cleaner, a motor housing, which is installed in the lower casing and includes the driving motor therein and an upper portion of which is opened upwardly, a filtering device installed onto the lower casing for filtering out foreign materials from introduced air, and an intermediate cover integrally formed with a first cover portion positioned onto an upper portion of the filtering device and a second cover portion for covering the upper portion of the motor housing. Further, a pressure switch for sensing pressure within the motor housing and a damper for introducing external air into the motor housing when the pressure within the motor housing is lowered below a predetermined pressure value are directly installed onto the second cover portion of the intermediate cover.

23 Claims, 6 Drawing Sheets

U.S. PATENT DOCUMENTS 5,881,430 A * 3/1999 Driessen et al. ..... 15/339
5,898,971 A * 5/1999 Contant ..... 15/412
5,937,477 A * 8/1999 Dyson ..... 15/327.7
6,026,539 A 2/2000 Mouw et al. ..... 15/339
6,167,588 B1 1/2001 Dyson ..... 15/339
6,484,350 B2 * 11/2002 Yung ..... 15/353
6,618,898 B2 * 9/2003 Tingle ..... 15/347

FOREIGN PATENT DOCUMENTS

EP 0365191 4/1990
EP 0378191 7/1990

* cited by examiner

DEVICE FOR PROTECTING MOTOR IN VACUUM CLEANER

This application is a Divisional of Application No. 09/989,460 filed Nov. 21, 2001 now U.S. Pat. No. 6,651, 294.

BACKGROUND OF THE INVENTION

1. Field of the Invention

The present invention relates to a vacuum cleaner, and more particularly, to a safety device by which a driving motor for generating suction force in a vacuum cleaner cannot be overloaded.

2. Description of the Prior Art

As shown in FIG. 1, a vacuum cleaner is generally constructed to comprise a main body 2, a connecting hose 4 connected to the main body 2, an extension tube 6 connected to the connecting hose 4, and a suction nozzle 8 mounted to a lower end of the extension tube 6.

A driving motor for generating suction force and a filtering device for filtering air containing foreign materials to be introduced are included in the main body 2. The connecting hose 4, which is manufactured in the form of a pipe made of flexible material, causes the main body 2 to be connected to the extension tube 6. The extension tube 6 is generally constructed to be extendable and contractible. Further, a handle gripped by a user is formed at an upper portion of the extension tube.

The suction force generated from the main body 2 is transferred to the suction nozzle 8 via the connecting hose 4 and the extension tube 6. In addition, since the suction nozzle 8 is usually used in a state where it is in contact with a surface to be cleaned, the foreign materials such as dusts on a room floor is introduced into the main body through the suction nozzle 8 together with the air. The air containing the foreign material introduced as such is introduced into the main body through the extension tube 6 and the connecting hose 4, and then is filtered.

FIG. 2 shows an interior structure of the main body 2 of the cleaner in a state where an upper casing of the main body 2 is opened. Referring to FIG. 2, the interior structure of the main body will be explained. As shown in this figure, a dust-collecting chamber 22*a* into which a dust-collecting bag such as a paper bag is inserted is provided within a lower casing 21 constructing a lower portion of the main body 2. The dust-collecting chamber 22*a* is divided by a partition 26, while a chamber 22*b* for accommodating the motor (hereinafter, referred to as a "motor chamber") is formed at the other side of the partition 26. A motor housing 24 in which the motor for generating the suction force is mounted is installed within the motor chamber 22*b*.

A motor cover 25 for opening and closing an upper portion of the motor housing 24 is provided with a connecting tube 25*a* that communicates with the motor chamber 22*b* located below the motor cover. Further, a dust-collecting bag (not shown) for allowing only the air, out of the air containing the introduced foreign materials, to be discharged to the outside is installed within the dust-collecting chamber 22*a*. Furthermore, a cover 28 in which a damper 28*a* is mounted is installed at an upper portion of the dust-collecting chamber 22*a*. The damper 28*a* has a construction that the damper is opened when pressure within the dust-collecting chamber 22*a* becomes lower than the atmosphere pressure, so that air outside the main body of the cleaner can be introduced into the dust-collecting chamber 22*a*. The structure of the damper 28*a* itself is well known, and thus, detailed description thereof will be omitted.

As shown in FIG. 3 in which a connecting relationship between the connecting tube 25*a* and the partition 26 is illustrated, the connecting tube 25*a* connected to the motor cover 25 is connected to a vent hole 26*a* formed in the partition 26, and a pressure switch 27 for sensing pressure within the dust-collecting chamber 22*a* is connected to an end of the connecting tube 25*a*. Thus, the pressure switch 27 is formed through the vent hole 26*a* so that it can sense the pressure within the dust-collecting chamber 22*a*.

The suction pressure generated when the motor installed within the motor housing 24 starts to operate is transferred to the suction nozzle 8, and consequently, the foreign materials such as dusts remaining on the room floor are introduced into the main body 2 through the suction nozzle 8. Further, only the air out of the air containing the foreign materials, which has been introduced into the dust-collecting bag inserted into the dust-collecting chamber within the main body, flows from the dust-collecting bag. Thus, the foreign materials such as dusts are gradually collected within the dust-collecting bag.

In addition, the air flowing from the inside to the outside of the dust-collecting bag passes through the interior of the motor housing 24, and is discharged to the outside of the cleaner. The reason why the air passes through the interior of the motor housing 24 is that the air should cool down the motor from which heat is generated during its operation.

If the dusts are collected in a large quantity within the dust-collecting bag or large foreign materials are caught in any one of the connecting nozzle 8, the extension tube 6 and the connecting hose 4 in the process of such an operation, the pressure within the dust-collecting chamber 22*a* is lowered. That is, the pressure within the dust-collecting chamber 22*a* is lowered, because the motor installed within the motor housing 24 incessantly performs its own discharge operation whereas a small quantity of the air is introduced into the dust-collecting chamber 22*a*.

Then, if the pressure is lowered, the motor installed within the motor housing 24 is substantially overloaded. That is, this is because the motor discharges the air within the dust-collecting chamber while operating in such a state where the air cannot be normally introduced into the dust-collecting chamber 22*a* due to the foreign materials sucked into the dust-collecting bag inserted into dust-collecting chamber. However, such an overload is not preferable since it exerts a critical influence on the function of the cleaner.

Therefore, in this case, the pressure switch 27 mounted to sense the pressure within dust-collecting chamber 22*a* through the vent hole 26*a* in the partition 26 can sense reduction of the pressure within the dust-collecting chamber. Further, based on the pressure sensed by the pressure switch 27, alarm lights or sounds can be produced to inform the user that the cleaner is in an abnormal state. Thus, the user can take measures such exchange of the dust-collecting bag.

On the other hand, in a case where the user cannot perceive such an alarm, the motor installed within the motor housing is continuously overloaded. Thus, the damper 28*a* mounted on the cover 28 starts to operate. That is, if the pressure within the dust-collecting chamber 22*a* is greatly lower than the outside pressure, the damper 28*a* is opened and the air outside the main body of the cleaner is then introduced into the dust-collecting chamber 22*a* so that the motor is prevented from being overloaded.

However, the vacuum cleaner constructed as such has the following problems.

The aforementioned damper 28*a* and pressure switch 27 are parts for eventually preventing the motor from being overloaded. According to the prior art mentioned above, however, the pressure switch 27 senses merely the pressure within the dust-collecting chamber 22*a*, and moreover, it measures the pressure through the connecting tube 25*a*. Thus, there is likelihood that any error in measurement of the pressure can be produced. Consequently the pressure cannot be accurately measured.

Further, since the air introduced through the damper 28*a* is introduced into the motor housing 24 via the dust-collecting chamber 22*a* and the dust-collecting bag, a sufficient quantity of the air is not substantially introduced into the motor housing 24. Thus, there is a disadvantage in that the motor cannot be sufficiently prevented from being overloaded.

Furthermore, the aforementioned conventional constitution is not substantially simple and requires the other components such as tubes. Thus, there is also a problem in that the number of parts is increased and fabricating processes become complicated.

SUMMARY OF THE INVENTION

Therefore, the present invention is contemplated to solve the aforementioned problems in the prior art. An object of the present invention is to provide a device for protecting a motor in a vacuum cleaner by which it can be more accurately sensed whether the motor is overloaded and a sufficient quantity of air can be directly introduced into a motor housing when the motor is overloaded.

Another object of the present invention is to provide a simplified device for protecting a motor in a vacuum cleaner.

According to an aspect of the present invention for achieving the objects, there is provided a device for protecting a motor in a vacuum cleaner, comprising a lower casing for forming a lower portion of a main body of the cleaner; a motor housing which is installed in the lower casing and includes the driving motor therein and of which an upper portion is opened upwardly; a filtering means installed onto the lower casing for filtering out foreign materials from introduced air; and an intermediate cover integrally formed with a first cover portion positioned onto an upper portion of the filtering means and a second cover portion for covering the upper portion of the motor housing, wherein a pressure switch for sensing pressure within the motor housing is directly installed onto the second cover portion of the intermediate cover.

Preferably, a damper for introducing external air into the motor housing when the pressure within the motor housing is lowered below a predetermined pressure value, may be further installed onto the second cover portion of the intermediate cover.

According to the present invention, overload imposed on the motor can be sensitively and accurately controlled since the pressure switch can directly sense the pressure within the motor housing. Further, external air can be directly introduced into the motor housing through the damper when the motor is overloaded. Therefore, there is an advantage in that the motor can be rapidly and sufficiently protected against its overload.

BRIEF DESCRIPTION OF THE DRAWINGS

The above objects and features of the present invention will become apparent from the following description of a preferred embodiment given in connection with the accompanying drawings, in which.

DETAILED DESCRIPTION OF THE INVENTION

Hereinafter, the present invention will be explained on the basis of a preferred embodiment thereof shown in the figures.

Figure 1:
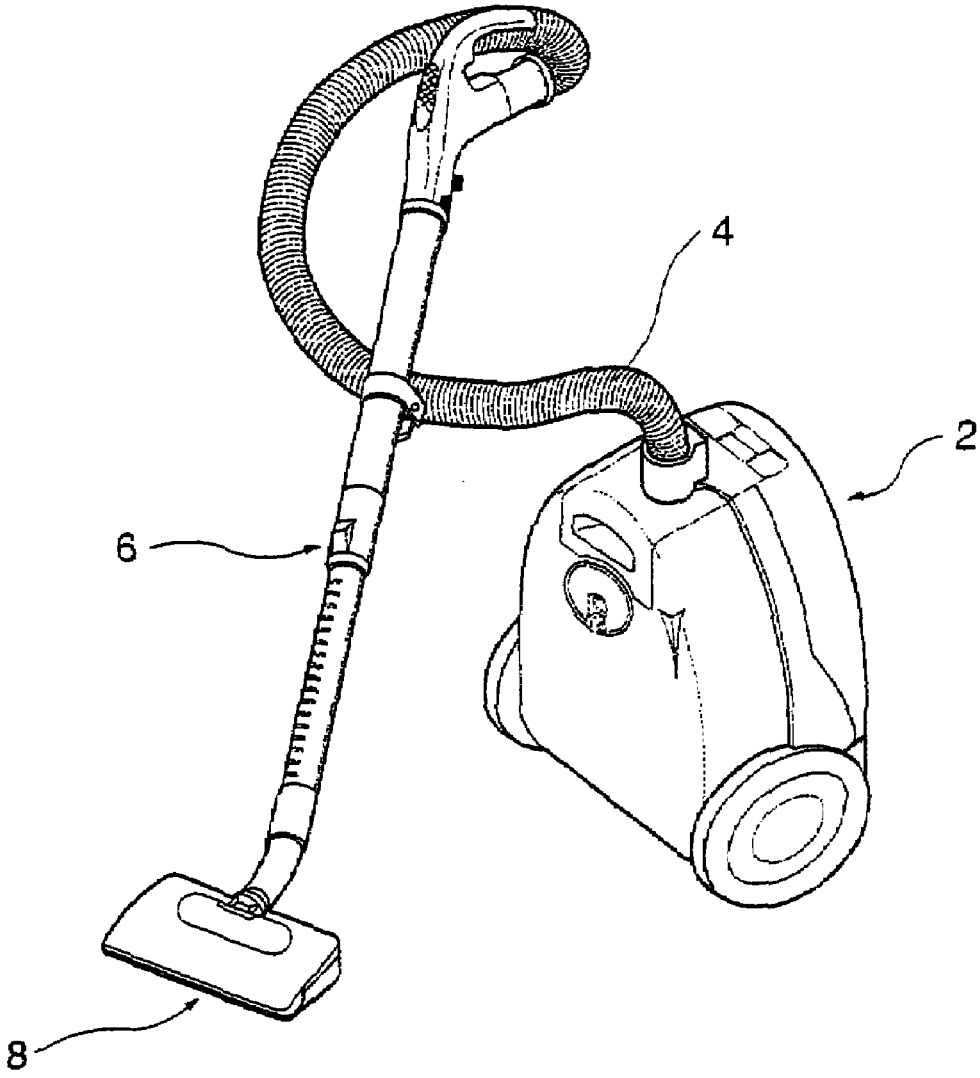
Fig.1 PRIOR ART
FIG. 1 is a perspective view of a conventional vacuum cleaner.
Figure 2:
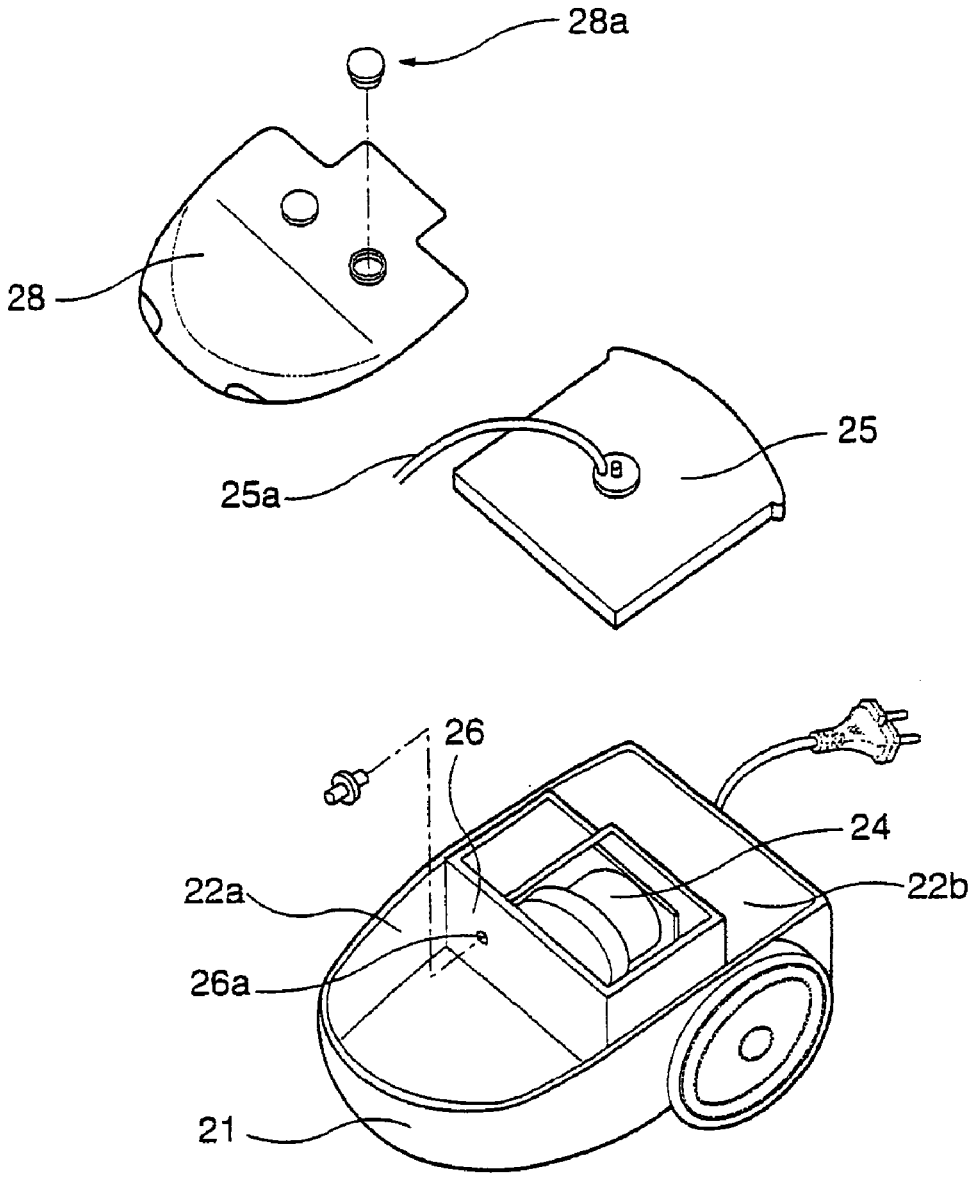
Fig. 2 PRIOR ART
FIG. 2 is an exploded perspective view of essential parts of the conventional vacuum cleaner.
Figure 3:
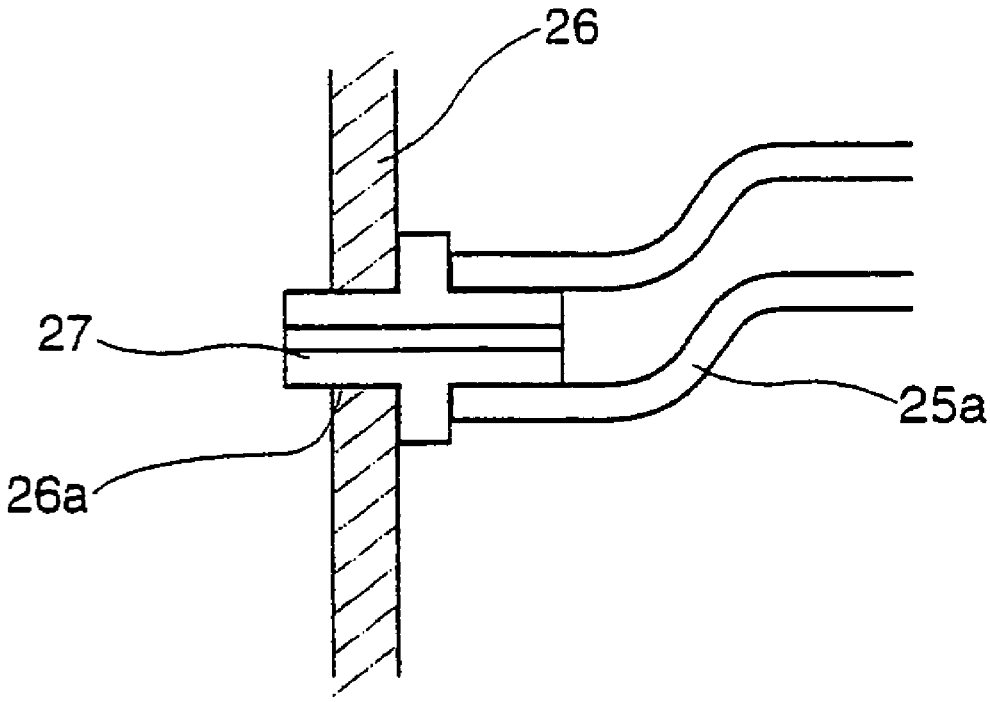
Fig. 3 PRIOR ART
FIG. 3 is a partial sectional view illustrating a state where a pressure switch mounted to a connecting tube is installed on a partition.
Figure 4:
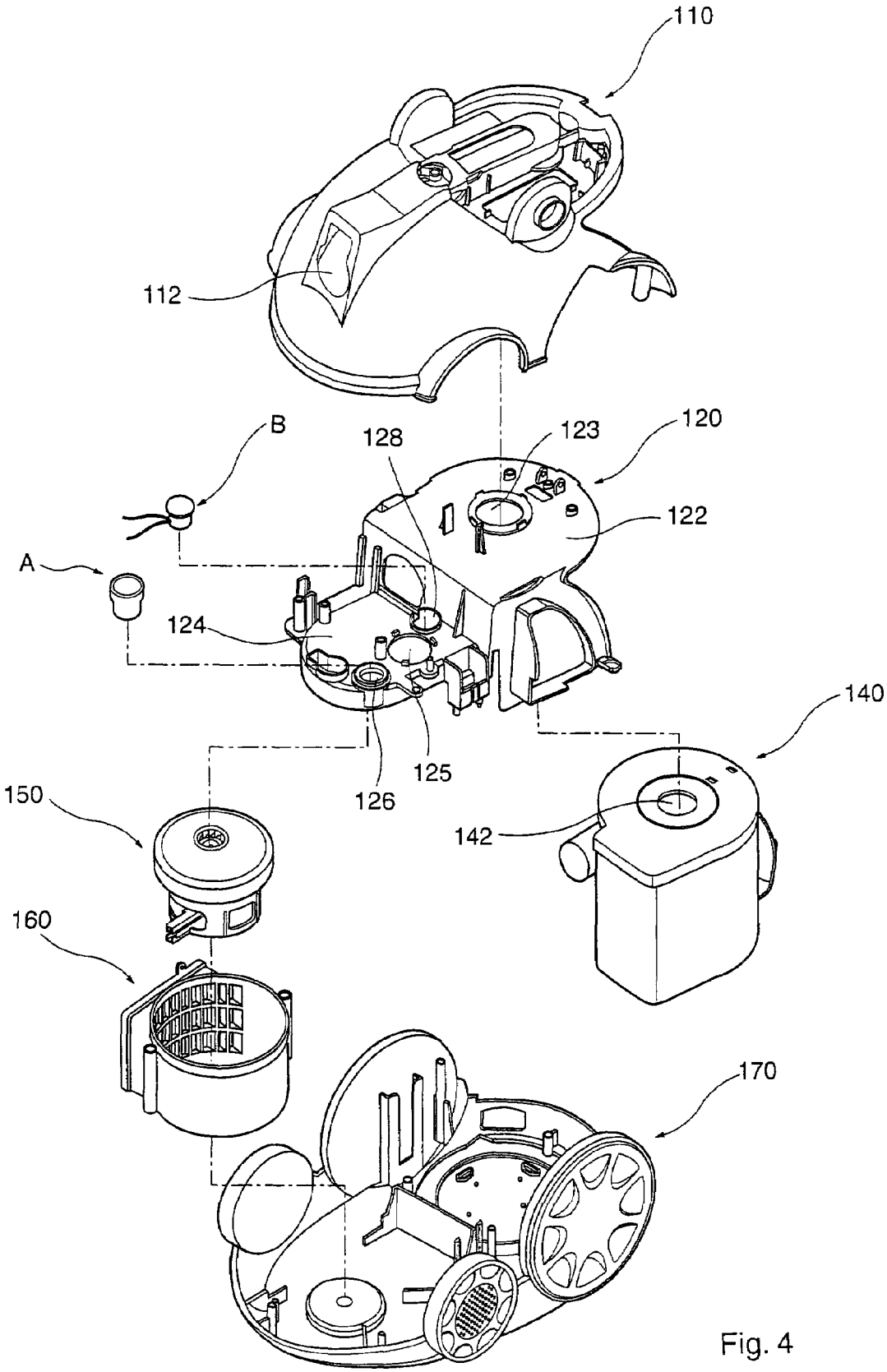
FIG. 4 is an exploded perspective view of essential parts of a vacuum cleaner according to the present invention.

First, the overall constitution of a vacuum cleaner according to the present invention will be described with reference to FIGS. 4 and 5. As shown in the figures, a main body of the vacuum cleaner comprises an upper casing 110 and a lower casing 170 that construct upper and lower portions of the main body, respectively. Parts of the vacuum cleaner to be described later are included in the upper casing 110 and the lower casing 170.

In addition, a motor housing 160 and a dust-collecting unit 140 are installed at front and rear portions on the lower casing 170, respectively. The dust-collecting unit 140 is adapted for filtering out foreign materials from air, in which the foreign materials introduced into the main body of the cleaner are contained, and for discharging the filtered air to the outside through the motor housing 160.

As for the dust-collecting unit 140, any kinds of the dust-collecting casings can be employed in the present invention if the foreign materials can be filtered out from the air introduced into the main body of the cleaner by the dust-collecting casing. For example, the dust-collecting unit 140 may be constructed such that both a primary dust collection performed in a cyclone mode and a secondary dust collection performed by the filter can be simultaneously made.

Figure 5:
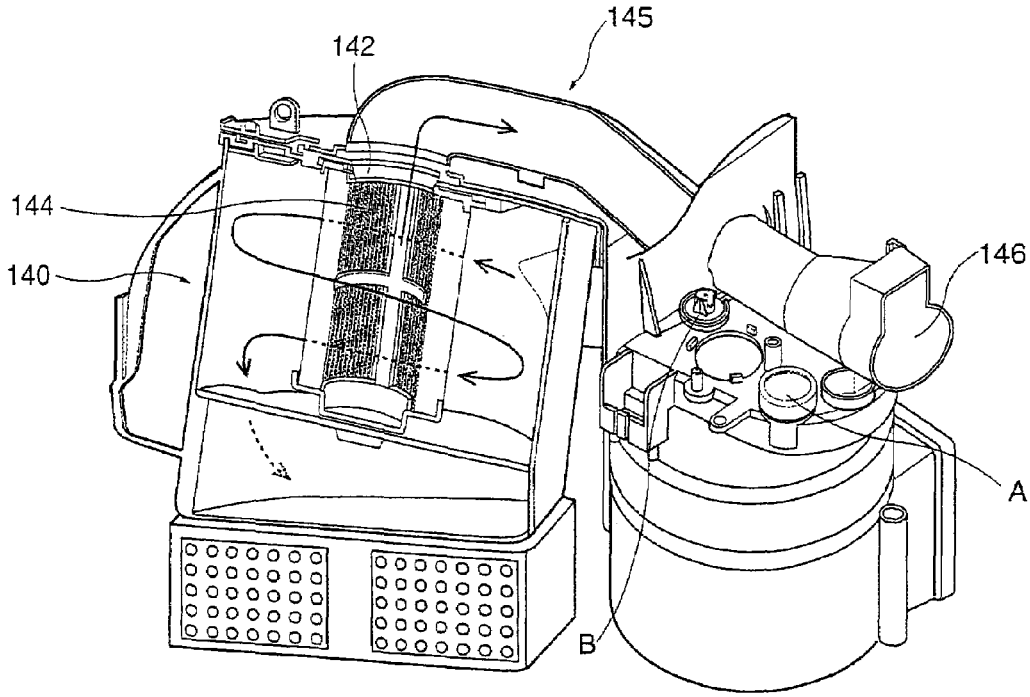
FIG. 5 is a view showing the constitution of a dust-collecting casing and a motor housing according to the present invention.

More specifically, as shown in FIG. 5, the primary dust collection in which the air containing the foreign materials introduced into the dust-collecting unit 140 is formed into a swirl flow within the dust-collecting unit 140 and materials having their own heavy weight fall due to their own weight while flowing along an inner surface of the dust-collecting casing, and the secondary dust collection in which fine dusts are filtered out while passing through a filter 144 made of paper or synthetic resin before the air subjected to the primary dust collection is discharged through an outlet 142, can be sequentially performed.

In addition, the motor housing 160 including a driving motor 150 therein is installed at a front portion of the lower casing 170. The driving motor 150 included in the motor housing 160 is a part for substantially generating suction force within the vacuum cleaner itself. The motor housing 160 is formed with an upper portion thereof opened upwardly, and the driving motor 150 is included therein. Thus, when the driving motor 150 operates, the suction force is generated. Further, by means of the suction force generated from the driving motor 150, the air containing the foreign materials such as dusts is introduced into the dust-collecting unit 140.

That is, by means of the suction force generated from the driving motor 150, the air containing the foreign materials is introduced into the main body of the cleaner through an inlet 146. Further, the inlet 146 is fitted into an inlet portion 112 of the upper casing 110 shown in FIG. 4.

The air, which has been introduced into the dust-collecting unit 140 through the inlet 146 and the foreign materials have been filtered out therefrom as mentioned above, is discharged through the outlet 142. For example, the filtered air is guided into the motor housing 160 through a connecting duct 145. Since an upper portion of the motor housing 160 is opened upwardly, the air introduced through the upper portion of the housing cools down the driving motor 150 while going through the motor, and then is discharged through one side of the motor housing 160.

An intermediate cover 120 is mounted over the dust-collecting unit 140 and the motor housing 160. The intermediate cover 120 is a part mounted to simultaneously cover upper portions of the motor housing 160 and the dust-collecting unit 140.

Further, the intermediate cover 120 is integrally formed with a first cover portion or dust-collecting casing cover portion 122 for covering the dust-collecting casing and a second cover portion or motor housing cover portion 124 for covering the motor housing. The dust-collecting casing cover portion 122 is positioned over the dust-collecting unit 140, and the motor housing cover portion 124 is formed to be stepped with respect to the dust-collecting casing cover portion 122 and comes into close contact with the upper portion of the motor housing 160. That is, the motor housing cover portion 124 for covering the motor housing 160 is mounted to be in close contact with the opened upper portion of the motor housing 160.

The dust-collecting casing covering portion 122 of the intermediate cover 120 is formed with an outlet hole 123 communicating with the outlet 142 of the dust-collecting unit 140. Further, the motor housing cover portion 124 of the cover 120 is formed with an inlet hole 125 for the motor housing, through which the air discharged from the outlet hole 123 is again introduced into the motor housing 160 via the connecting duct 145.

Thus, the motor housing 160 is substantially covered with and is hermetically sealed by the motor housing cover portion 124 that has come into close contact with the opened upper portion of the motor housing 160. Further, it is constructed such that the air can be introduced, through the inlet hole 125 of the motor housing, into such a sealed space of the motor housing 160.

According to the present invention, the motor housing cover portion 124 for covering the motor housing is formed with a damper mounting hole 126 and a switch mounting hole 128 which communicate with the motor housing. A damper A is installed in the damper mounting hole 126. The damper A is constructed such that it can be opened by means of pressure difference between the locations over and below the motor housing cover portion 124 of the intermediate cover 120. That is, the damper A is opened when the pressure over the intermediate cover 120 is higher than the pressure below the intermediate cover, and thus, the air is introduced below the intermediate cover 120 (i.e., into the motor housing 160). Although the damper A has been already well known in the art, the constitution thereof will be briefly described with reference to FIG. 6.

As shown in this figure, the damper A comprises a casing Aa with apertures formed at upper and lower portions thereof, a shield plate Ab mounted to the upper portion of the casing, and a spring Ac for urging the shield plate Ab upwardly to hermetically seal the upper aperture. Thus, when the pressure below the intermediate cover 120 to which the damper A is installed (i.e., the pressure within the motor housing) is lowered, the spring Ac is compressed by means of the pressure difference, and then, the shield plate Ab moves downwardly. At this time, the air over the intermediate cover 120 can be introduced into the damper through the upper aperture, and then, be introduced into the motor housing 160 through the lower aperture.

A pressure switch or sensor B is mounted to the switch mounting hole 128 of the intermediate cover 120. The pressure switch B is generally used for measuring the pressure within the motor housing 160 located below the intermediate cover 120. Since the constitution of the pressure sensor itself is well known in the art, the detailed description thereof will be omitted.

Next, an overall operation of the vacuum cleaner of the present invention constructed as such will be explained.

When the driving motor 150 installed within the motor housing 160 starts to operate, the suction force is generated in the vacuum cleaner. As shown in FIG. 5, the air mixed with the foreign materials, for example, the air in which the foreign materials from the room floor etc. is contained, is introduced into the cleaner through the inlet 146 fitted into the inlet portion 112 formed on the upper casing 110.

The air introduced through the inlet 146 is also introduced into the dust-collecting unit 140 in which the foreign materials contained in the air are in turn completely filtered out. For example, as described above, the foreign materials contained in the air are completely filtered out in the process of the primary dust collection performed in the cyclone mode and the secondary dust collection performed by the filter.

The air discharged from the dust-collecting unit 140 is introduced into motor housing 160 through the connecting duct 145. The air introduced into the motor housing 160 cools down the motor that radiates heat during its operation, and then, is discharged to the outside through the side of the motor housing.

When the vacuum cleaner operates in such a manner, any problems may occur in the interior of the dust-collecting unit 140. For example, when wastepaper is introduced into the main body of the cleaner and then wraps around and adheres to an outer surface of the filter installed within the dust-collecting unit 140, the driving motor 150 is overloaded. That is, although the driving motor 150 normally operates, the air cannot be normally introduced from the dust-collecting unit 140 into the motor housing 160. Thus, the driving motor 150 is overloaded.

At this time, when the driving motor 150 is overloaded, the pressure within the space defined by the second covering portion 124 of the intermediate cover 120 and the motor housing 160 is lowered. Alternatively, if the introduced foreign materials are caught in the suction nozzle, the extension tube, the connecting hose or the like of the vacuum cleaner, the pressure within the motor housing 160 is also lowered. If the pressure is lowered as described above, the pressure switch B firstly senses reduction of the pressure. Then, in accordance with a signal corresponding to the pressure sensed by the pressure switch B, either a buzzer or a light emitting means such as LED informs the user that the vacuum cleaner is in an abnormal state. Further, according to the present invention, since the pressure switch B is directly installed onto the motor housing cover portion 124 for covering the motor housing 160, the pressure reduction within the motor housing 160 can be sensed in the most sensitive and accurate manner.

Therefore, when the user perceives that the vacuum cleaner is in an abnormal state, the user can stop using the cleaner, inspect the dust-collecting casing, and remove a cause of the malfunction of the cleaner (e.g., a state where the wastepaper is wrapped around the filter 144 of the dust-collecting casing). Accordingly, after the cause of the malfunction of the cleaner has been removed, the vacuum cleaner can normally operate again.

However, if the user does not still perceive an alarm sound or light in accordance with the sensed signal from the pressure switch B, the load imposed on the driving motor 150 of the vacuum cleaner is further increased. If the load is increased, critical damage by which the driving motor 150 cannot perform its own normal operation may be produced.

Therefore, when the overload imposed on the driving motor 150 has lasted for a predetermined period of time and the pressure within the motor housing is further decreased, the damper A mounted to the motor housing cover portion 124 of the intermediate cover 120 starts to operate.

Figure 6:
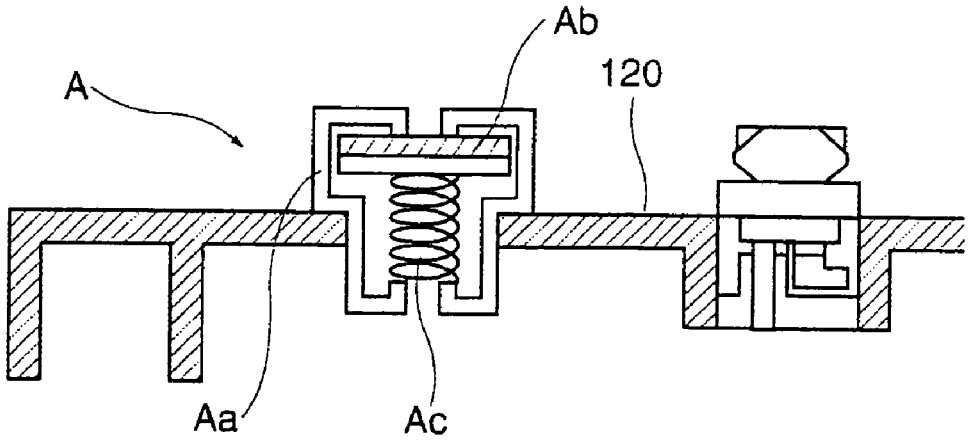
FIG. 6 is a sectional view showing the constitution of a damper employed in the present invention.

The damper A is constructed to be opened by means of the pressure difference between the locations over the intermediate cover 120 and within the motor housing 160, which is generated due to the pressure reduction in the motor housing 160. That is, as shown in FIG. 6, the spring Ac is compressed by means of the pressure difference between the locations over the intermediate cover 120 and within the motor housing 160. Then, the shield plate Ab moves downwardly and the upper aperture of the damper A is opened. Consequently, the external air is introduced into the motor housing 160. Since the external air is introduced into the motor housing as such, the overload imposed on the driving motor 150 can be removed.

According to the present invention, since the damper A is directly mounted on the motor housing cover portion 124 for covering the motor housing, the overload imposed on the motor can be sufficiently removed. It can be most sensitively determined by sensing the pressure within the motor housing 160 whether the driving motor 150 is overloaded. Further, the overload imposed on the driving motor 150 can be most rapidly and sufficiently solved by directly introducing the external air into the motor housing 160.

As described above, it can be understood that it is a basic technical feature or spirit of the present invention to directly install the damper A and the pressure switch B onto the motor housing cover portion 124 of the intermediate cover 120, which serves as the upper portion of the motor housing 160.

According to the present invention constructed as such, the overload imposed on the driving motor can be sensed most sensitively and accurately. Thus, the overload can be rapidly alarmed to and solved by the user. Accordingly, an advantage that reliability of the products can be further improved is expected.

It will be understood by a person skilled in the art that various changes and modifications may be made without departing from the spirit and scope of the invention.

For example, according to the preferred embodiment of the present invention, the dust-collecting unit 140 has been used as an example of a filtering means for removing the foreign materials from the air in which the foreign materials introduced into the main body of the vacuum cleaner are contained. However, it is apparent in the present invention that the filtering device for filtering out the foreign materials cannot be limited to the aforementioned dust-collecting unit 140. That is, it is apparent that the other means for filtering out the foreign materials can be installed instead of the dust-collecting unit 140. For example, the dust-collecting bag made of paper may be employed in the present invention.

Further, it is apparent that the present invention should be construed only by the appended claims.

The invention claimed is:

1. A device for protecting a driving motor in a vacuum cleaner, comprising:

a lower casing forming a lower portion of a main body of a vacuum cleaner;

a motor housing installed in the lower casing and configured to receive therein a driving motor;

a cover configured to directly cover and protect the motor housing; and a damper provided in a surface of the cover above the motor housing.

2. The device as claimed in claim 1, further comprising an upper casing forming an upper portion of the main body of the vacuum cleaner.

3. The device as claimed in claim 2, further comprising a filtering chamber installed on the lower casing.

4. The device as claimed in claim 3, wherein the filtering chamber comprises a filtering device.

5. The device as claimed in claim 3, wherein the cover covers and protects both the motor housing and the filtering chamber.

6. The device as claimed in claim 5, wherein the cover is positioned intermediate the upper casing and the motor housing and filtering chamber.

7. The device as claimed in claim 3, wherein the motor housing is provided in a front portion of the main body of the vacuum cleaner and the filtering chamber is provided in a rear portion of the main body of the vacuum cleaner.

8. The device as claimed in claim 1, further comprising a pressure sensor positioned on the cover and configured to sense pressure within the motor housing.

9. A vacuum cleaner comprising the device of claim 1.

10. A device for protecting a driving motor in a vacuum cleaner, comprising:

a lower casing configured to form a lower portion of a main body of a vacuum cleaner;

an upper casing configured to form an upper portion of the main body of the vacuum cleaner;

a motor housing installed in a front portion of the lower casing and configured to receive therein a driving motor;

an inlet formed in a front portion of the upper casing and configured to receive therethrough suction air into the vacuum cleaner; and a filtering device installed in a rear portion of the lower casing and configured to create a downwardly swirling flow of suction air, wherein suction air is received into an upper portion of the filtering device and flows downward, the suction air being discharged out of the vacuum cleaner through an outlet, and wherein the filtering device comprises a filter configured to filter foreign materials contained in the suction air, a portion falling from the suction air due to gravity and another portion being removed from the suction air by the filter.

11. The device as claimed in claim 10, further comprising an outlet in an upper portion of the filtering device through which filtered suction air is discharged.

12. The device as claimed in claim 10, wherein the motor housing is provided in a front portion of the main body of the vacuum cleaner and the filtering device is provided in a rear portion of the main body of the vacuum cleaner.

13. A vacuum cleaner comprising the device of claim 10.

14. A device for protecting a driving motor in a vacuum cleaner, comprising:

a canister formed by a lower casing and an upper casing to form a chamber within the canister, a first portion of the chamber serving as a collection chamber and a second portion of the chamber serving as a motor housing;

a motor located in the second portion within the motor housing, wherein a central longitudinal axis of the motor is oriented substantially vertically with respect to the upper and lower casings;

an inlet formed at a front portion of the canister and configured to receive therethrough suction air into the vacuum cleaner, wherein the first portion of the chamber is a rear portion of the vacuum cleaner and the second portion of the chamber is a front portion of the vacuum cleaner, and a pressure sensor positioned on a cover positioned intermediate the upper casing and the motor casing and configured to sense pressure within the motor housing.

15. The device as claimed in claim 14, further comprising an inlet formed at a front portion of the collection chamber.

16. The device as claimed in claim 14, wherein the cover covers and protects both the motor housing and the collection chamber.

17. The device as claimed in claim 14, further comprising a damper provided in a surface of the cover above the motor housing.

18. A vacuum cleaner comprising the device of claim 14.

19. A device for protecting a driving motor in a vacuum cleaner, comprising:

a canister formed by a lower casing and an upper casing to form a chamber within the canister, a rear portion of the canister serving as a collection chamber and a front portion of the canister serving as a motor housing;

an inlet formed at the front portion of the canister and configured to receive therethrough suction air into the vacuum cleaner;

a motor located in the front portion of the chamber within the motor housing; and a pressure sensor positioned on a cover positioned intermediate the upper casing and the motor housing and configured to sense pressure within the motor housing.

20. The device as claimed in claim 19, further comprising an inlet formed at the front portion of the canister.

21. The device as claimed in claim 19, wherein the cover covers and protects both the motor housing and the collection chamber.

22. The device as claimed in claim 19, further comprising a damper provided in a surface of the cover above the motor housing.

23. A vacuum cleaner comprising the device of claim 19.

* * * * *